United States Patent [19]

Roberge et al.

[11] 4,306,919

[45] Dec. 22, 1981

[54] PROCESS FOR CARBURIZING STEEL

[75] Inventors: Raymond P. Roberge, Chappaqua; Jack Solomon, Rye, both of N.Y.

[73] Assignee: Union Carbide Corporation, New York, N.Y.

[21] Appl. No.: 184,065

[22] Filed: Sep. 4, 1980

[51] Int. Cl.[3] ..... C21D 1/48

[52] U.S. Cl. ..... 148/16.5; 148/16.7; 148/20.3

[58] Field of Search ..... 148/16, 16.5, 16.6, 148/16.7, 20.3

[56] References Cited

U.S. PATENT DOCUMENTS 4,145,232 3/1979 Solomon ..... 148/20.3

OTHER PUBLICATIONS

Metals Handbook 8th ed., vol. 2, pp. 96–97 American Society for Metals 1964.

*Primary Examiner*—L. Dewayne Rutledge
*Assistant Examiner*—John P. Sheehan
*Attorney, Agent, or Firm*—Saul R. Bresch

[57] ABSTRACT

In a process for carburizing steel parts, wherein it is desired to shut down the carburizing process for a predetermined period of time without removing the parts, the improvement comprising the following steps:

(a) introducing parts, which would not achieve 100 percent carburization prior to the shut down of the carburizing process, into the furnace;

(b) determining the temperature (Tc,s) for each temperature zone at about which the parts introduced in step (a) are to be maintained in step (c)

$$Tc,s = \left[ -\frac{R}{Q} \ln \left( \frac{tn - teq,susp}{tn} \right) + \frac{1}{Tn} \right]^{-1}$$

wherein:

$$teq,susp = \int_{ti}^{ta,c} \exp\left[ -\frac{Q}{R}\left(\frac{1}{T} - \frac{1}{Tn}\right)\right] dt + \int_{ta,h}^{tf} \exp\left[ -\frac{Q}{R}\left(\frac{1}{T} - \frac{1}{Tn}\right)\right] dt,$$

(c) maintaining the parts in the carburizing atmosphere at the temperature determined in step (b) for that temperature zone;

(d) reducing the amount of the hydrocarbon component of the atmosphere;

(e) gradually lowering the temperature from the level of step (c) to a predetermined level, less than about 1400° F.;

(f) during step (e), but before the temperature reaches about 1400° F., changing the atmosphere to one comprising an inert atmosphere;

(g) maintaining the parts in this atmosphere, for the predetermined period of time;

(h) after the predetermined period of time expires, heating the furnace to a temperature in the range of about 1400° F. to about 1500° F.;

(i) changing the atmosphere to the carburizing atmosphere;

(j) raising the temperature in each zone to about the temperature determined in step (b);

(k) maintaining the parts at the temperature of step (j) for the period of time necessary to bring the carburization initiated in step (c) to about 100 percent carburization; and (l) removing the parts from the furnace.

20 Claims, No Drawings

PROCESS FOR CARBURIZING STEEL

FIELD OF THE INVENTION

This invention relates to a process for the gas carburizing of steel and, more particularly, to a process for suspended carburizing.

DESCRIPTION OF THE PRIOR ART

Carburizing is the conventional mode for case hardening low carbon steel. In gas carburizing, the steel is exposed to a rapidly flowing carburizing atmosphere for a predetermined period of time until the desired amount of carbon is introduced into the surface of the steel to a predetermined depth of the case. The case has good wear properties because of its extreme hardness while the inner portion of the steel, i.e., that portion beyond the case depth, referred to as the core, remains relatively soft and ductile and has good toughness qualities. Case hardened steels are utilized in gears, camshafts, shells, cylinders, and pins, for example, where the combination of a wear resistant surface with a tough core is so important. Carburizing, and particularly gas carburizing, carbonitriding, and a more extensive list of various steel parts subjected to carburizing are described in the "Metals Handbook," edited by T. Lyman, published by the American Society for Metals, Novelty, Ohio, 1948, pages 677 to 697. Carburizing and box and pit furnaces in which the carburizing process is carried out as described in "The Making, Shaping and Treating of Steel," 8th edition, 1964, pages 1058 to 1068. Carburizing furnaces are also described in the same "Metals Handbook" referred to above in an article "Electrically Heated Industrial Furnaces," by Cherry et al., pages 273 to 278, particularly FIGS. 1, 2, and 8, the latter being an example of a pusher furnace, which is commonly used for carburizing in a continuous manner, as an alternative to batch processing.

In U.S. Pat. No. 4,145,232, which is incorporated by reference herein, a particular process for carburizing is described. As background, typical apparatus, sources and components of atmospheres, as well as procedures, used in carburizing are given. One aspect, which is not touched on is the problem of shutdown. One cannot, with respect to a carburizing furnace, simply turn off the furnace and not be concerned with the effect on the parts of residual temperature and atmosphere. Therefore, at present, carburizing furnaces are emptied of parts prior to a shutdown even though emptying a pusher furnace is costly because it results in several hours of lost production time. A pusher furnace is a double-ended box furnace with a mechanism for moving parts through the furnace in a semi-continuous manner. Usually the parts to be carburized are placed in trays or baskets. As each tray is pushed into the furnace, it moves the preceding trays one step through the furnace. The residence time of parts in a pusher furnace depends on the desired case depth, but is typically between 2 and 36 hours. Prior to a shutdown, empty trays are pushed into the furnace until all trays loaded with parts have been pushed out. It is common practice to burn out the carburizing atmosphere, and to lower the furnace temperature by about 200° F., after the furnace has been emptied. At the end of the shutdown period, the furnace temperature is raised to that desired for carburizing and the carburizing atmosphere is restored. When the operator has achieved the desired carbon potential in the furnace atmosphere, he starts the push cycle. Loaded trays are pushed in, but since the furnace is full of empty trays, no parts are pushed out of the furnace for a period of time equal to the residence time. Consequently, each time the furnace is shut down, several hours of fully manned production time are lost. Since many heat treating shops down their pusher furnaces once a week, the present practice results in a significant loss of production time.

Batch furnaces are well suited to the presently used shutdown procedures since the furnace is emptied after each load is carburized. The operator schedules the work such that a load is removed shortly before the desired shutdown time. There is, however, a scheduling problem for parts which require a long carburizing time. It is not always possible to schedule these runs such that the furnace is used effectively up to the shutdown time. For example, a load which requires 12 hours in the furnace cannot be loaded if only 10 hours remain before the shutdown time. Thus, 10 hours of fully manned furnace time is wasted.

In order to avoid the loss of fully manned production time, it was suggested that the parts be left in the furnace at lower temperatures with a nitrogen purge, but this has led to problems of exessive case depth, decarburization, and oxidation of parts as well as failure to maintain hardness profile and grain size and prevent dimensional distortion and retained carbides, and, once any one of these deficiencies has occurred, there is no economic way the part can be restored. It is clear, then, that, just as the carburizing process itself must be controlled so that the steel parts meet exacting metallurgical and production specifications, so any attempt at leaving parts in the furnace in order to economize on production time, must be controlled, if those parts are to meet specifications.

SUMMARY OF THE INVENTION

An object of this invention, therefore, is to provide an improvement in known carburizing processes which will permit the suspension of such processes for a predetermined period without an adverse effect on the steel parts left in the furnace during that period.

Other objects and advantages will become apparent hereinafter.

According to the present invention, an improvement in the known process for carburizing has been discovered which meets the aforementioned objective. The known process can be broadly defined as a process for carburizing steel parts in a furnace having one or more temperature zones at a carburizing temperature in the range of about 1500° F. to about 2200° F. in a carburizing atmosphere comprising

| component of atmosphere | percent by volume |
|---|---|
| carbon monoxide | about 4 to about 30 |
| hydrogen | about 10 to about 60 |
| nitrogen | about 10 to about 85 |
| carbon dioxide | 0 to about 4 |
| water vapor | 0 to about 5 |
| hydrocarbon | about 1 to about 10, |

said percent by volume being based on the total volume of the atmosphere.

When it is desired to shut down the carburizing process for a predetermined period of time without removing the parts, which have not achieved 100 percent carburization, from the furnace, subject improvement is effected comprising the following steps:

(a) introducing parts, which would not achieve 100 percent carburization prior to the shutdown of the carburizing process, into the furnace;

(b) determining the temperature (Tc,s) for each temperature zone at about which the parts introduced in step (a) are to be maintained in step (c) according to the following formula:

$$Tc,s = \left[ -\frac{R}{Q} \ln\left( \frac{tn - teq,susp}{tn} \right) + \frac{1}{Tn} \right]^{-1}$$

wherein:

$$teq,susp = \int_{ti}^{ta,c} \exp\left[ -\frac{Q}{R}\left( \frac{1}{T} - \frac{1}{Tn} \right) \right] dt + \int_{ta,h}^{tf} \exp\left[ -\frac{Q}{R}\left( \frac{1}{T} - \frac{1}{Tn} \right) \right] dt,$$

teq,susp. being allocated to at least one temperature zone.

R=gas constant

Q=activation energy for carbon diffusion in austenite ln=natural log tn=carburizing time ti=time at beginning of shutdown ta,c=time during cooling at which T=Ta ta,h=time during heating at which T=Ta tf=time at end of shutdown at which T=Tc,s Tn=carburizing temperature T=temperature during cooling and heating, a function of time, t Ta=austenitic transformation temperature, provided that Tc,s is no less than about 1400° F. or the austenitic transformation temperature of the steel, whichever is the greater;

(c) maintaining the parts in the carburizing atmosphere in at least one of the temperature zones for the period of time, which would be necessary to achieve about 1 to about 99 percent carburization at the carburizing temperature, each of said temperature zones being at the temperature determined in step (b) for that temperature zone;

(d) reducing the amount of the hydrocarbon component of the atmosphere;

(e) gradually lowering the temperature from the level of step (c) to a predetermined level, less than about 1400° F.;

(f) during step (e), but before the temperature reaches about 1400° F., changing the atmosphere to one comprising an inert atmosphere;

(g) maintaining the arts in the atmosphere, which is the result of step (f), for the predetermined period of time;

(h) after the predetermined period of time expires, heating the furnace to a temperature in the range of about 1400° F. to about 1500° F.;

(i) changing the atmosphere to the carburizing atmosphere;

(j) raising the temperature in each zone to about the temperature determined in step (b);

(k) maintaining the parts at the temperature of step (j) for the period of time necessary to bring the carburization initiated in step (c) to about 100 percent carburization; and (l) removing the parts from the furnace.

DESCRIPTION OF THE PREFERRED EMBODIMENT

The improvement in conventional carburizing processes, which is the subject of this specification, will also be referred to as a "suspended carburizing" process or a "suspend" process. Generally speaking, in order for suspended carburizing to be viable commercially, the resulting parts must be the metallurgical equivalent of those resulting from the conventional process of which suspended carburizing can be considered an extension. It is considered that the subject invention achieves this end while previously known suspended carburizing techniques, if their parts are acceptable at all, are metallurgically inferior to parts produced by the regular carburizing process. It is not surprising that these known suspended carburizing processes are not in widespread use, and then only where case depth is of a noncritical nature.

As mentioned above, the purpose of carburizing is to form a high carbon content layer or "case" at the surface of a steel part. Carburized parts have a surface carbon and/or surface hardness specification, e.g., surface carbon of 0.8 to 1.1 weight percent, or surface hardness of Rockwell C 58 to 62. The desired surface carbon is obtained by controlling the carbon potential of the carburizing atmosphere.

Carburized parts also have a case depth specification, i.e., an acceptable range in either total or effective case depth. Case depth is defined as the depth into the part at which the carbon content is equal to a specified level. Total case depth is the depth at which the carbon content is equal to that of the base metal. Effective case depth is defined as the depth at a specified hardness or carbon level, e.g., at Rockwell C 50 or at 0.4 weight percent carbon. The desired case depth is obtained by setting the carburizing time and temperature such that carbon diffuses into the part to the required depth. The normal carburizing temperature is always greater than the austenite transformation temperature for the alloy being treated, and is usually between about 1550° and about 1750° F. The rate of carbon diffusion increases with temperature, and the total amount of case depth increases with carburizing time.

At any given time, parts in a pusher furnace are at various degrees of completeness in terms of establishing the desired surface carbon and case depth. Thus, parts which have just been pushed into the furnace have picked up little or no carbon while parts that are ready to be pushed out of the furnace have fully achieved the desired surface carbon and case depth. A suspend process, which is to be critically considered the equivalent of the carburizing process with which it is associated, must control carbon transport so that all parts achieve acceptable carbon profiles whether they are suspended at the beginning, middle, or end of the carburizing cycle. In other words, the suspended process must be such that it brings the part up to "100 percent carburization" which means, insofar as this specification is concerned, that the part is brought to the desired level of surface carbon and case depth. The total time required for subject process is one full push or carburizing cycle plus the period of the shutdown, e.g., if the cycle is 14 hours, a part is initially subjected to the process for 6 hours at Tc,s; is maintained during shutdown for 48 hours; and completes the cycle at Tc,s for 8 hours at which time the parts will have achieved 100 percent carburization.

While the subject process can be used for periods of shutdown of any length, it is most economical for a period lasting up to about 3 days where temperatures above about 600° F. are maintained. Beyond about 3 days, it is recommended that the temperature be dropped to less than about 600° F. and that no atmosphere be used.

The length of the carburizing cycle is determined based on the time needed to bring the parts to 100 percent carburization at the carburizing temperature. With knowledge of the length of the carburizing cycle and the point in time at which it has been decided to suspend carburizing, step (a) is carried out, i.e., the introduction into the furnace of parts, which would not achieve 100 percent carburization prior to the shutdown of the carburizing process, i.e., if the carburizing process was run at the normal carburizing temperature of 1500° F. to 2200° F. for the carburizing cycle in the normal carburizing atmosphere mentioned above. The term "normal" refers to the conventional carburizing process, which it is desired to shut down. This same cycle is used in the suspended carburizing process; however, the carburizing temperature during the cycle is lowered to Tc,s, and the cycle is usually broken up, one part of the cycle being carried out before shutdown and the balance of the cycle after shutdown.

Since pusher furnaces generally have several temperature control zones, case depth compensation can be achieved by carburizing suspended parts at a lower temperature. This is accomplished by lowering and raising furnace temperatures sequentially in zones before and after the suspend so that parts which undergo a suspend are carburized at a lower temperature, Tc,s. Table I illustrates this procedure. The carburizing temperature for suspended parts, Tc,s, is specified such that the carbon diffusion gained during the shutdown is offset by a corresponding lowering of carbon diffusion during the carburizing cycle used in subject process. An estimate of the effective carburizing time which will accrue during a shutdown (teq,susp) allows one to specify Tc,s such that the expected case depth for a suspended part is equal to that of a normal part.

TABLE I

Zone Temperatures Before and After a Shutdown
Basis: 10 hour normal residence time
5 zone furnace, 1700° F. normal carburizing temperature in zones 1 to 5

| | Temperature (°F.) | | | | |
|---|---|---|---|---|---|
| Time (hours) | Zone 1 | Zone 2 | Zone 3 | Zone 4 | Zone 5 |
| −10 | 1700 | 1700 | 1700 | 1700 | 1700 |
| −8 | Tc,s | 1700 | 1700 | 1700 | 1700 |
| −6 | Tc,s | Tc,s | 1700 | 1700 | 1700 |
| −4 | Tc,s | Tc,s | Tc,s | 1700 | 1700 |
| −2 | Tc,s | Tc,s | Tc,s | Tc,s | 1700 |
| 0 | Tc,s | Tc,s | Tc,s | Tc,s | Tc,s |
| Stop Push | | | | | |
| Shutdown | | | | | |
| Start Push | see steps (e) through (i) | | | | |
| 0 | Tc,s | Tc,s | Tc,s | Tc,s | Tc,s |
| 2 | 1700 | Tc,s | Tc,s | Tc,s | Tc,s |
| 4 | 1700 | 1700 | Tc,s | Tc,s | Tc,s |
| 6 | 1700 | 1700 | 1700 | Tc,s | Tc,s |
| 8 | 1700 | 1700 | 1700 | 1700 | Tc,s |
| 10 | 1700 | 1700 | 1700 | 1700 | 1700 |

In step (b), the temperature at about which the parts introduced in step (a) are to be maintained in step (c) is determined by applying the following formula:

$$Tc,s = \left[ -\frac{R}{Q} \ln\left( \frac{tn - teq,susp}{tn} \right) + \frac{1}{Tn} \right]^{-1}$$

wherein:

$$teq,susp = \int_{ti}^{ta,c} \exp\left[ -\frac{Q}{R}\left( \frac{1}{T} - \frac{1}{Tn} \right) \right] dt + \int_{ta,h}^{tf} \exp\left[ -\frac{Q}{R}\left( \frac{1}{T} - \frac{1}{Tn} \right) \right] dt,$$

teq,susp being allocated to at least one temperature zone

R = gas constant

Q = activation energy for carbon diffusion in austenite ln = natural log tn = carburizing time ti = time at beginning of shutdown ta,c = time during cooling at which T = Ta ta,h = time during heating at which T = Ta tf = time at end of shutdown at which T = Tc,s Tn = carburizing temperature T = temperature during cooling and heating, a function of time, t Ta = austenitic transformation temperature for accomplishing case depth compensation, which is an integral part of subject improvement, provided that Tc,s is no less than about (i) 1400° F. or (ii) the austenitic transformation temperature of the steel, whichever is the greater.

The term "teq,susp" is the equivalent carburizing time gained during the cooling and heating portions of the suspend process. It can be allocated to one temperature zone or divided among two or more temperature zones. The allocation is discussed in more detail below. R, the gas constant is 1.987 BTU per mole ° R. Q, the activation energy for carbon diffusion in austenite, is 61,900 BTU per mole. Ta, the austenitic transformation temperature, is a function of alloying elements, being about 1800° R. for carbon steel. It is understood that all temperatures used in the formulas are expressed on an absolute temperature scale, e.g., ° R.

A preferred way of solving for teq,susp is to replace the integrals in the above equation with summations as follows:

$$teq,susp = \sum_{j=1}^{nc} \exp\left[ -\frac{Q}{R}\left( \frac{1}{Tj} - \frac{1}{Tn} \right) \right] \Delta tj$$

$$\sum_{j=1}^{nh} \exp\left[ -\frac{Q}{R}\left( \frac{1}{Tj} - \frac{1}{Tn} \right) \right] \Delta tj$$

wherein the first summation applies to the cooling steps of the suspend process and the second summation applies to the heating steps and nc = number of time increments during cooling from Tc,s to Ta nh = number of time increments during heating from Ta to Tc,s Tj = average temperature during time increment j $\Delta tj$ = length of time increment j Another way of solving for teq,susp is by comparing the case depth of parts suspended in a test load in which Tc,s is set at Tn to the case depth of parts carburized at Tn without the suspend process, i.e., carburized conventionally. The teq,susp is then calculated as follows:

$$teq,susp = \left[\left(\frac{Xs}{Xn}\right)^2 - 1\right] tn$$

wherein Xs = case depth of parts subjected to carburizing in a test load where Tc,s = Tn Xn = case depth of parts carburized at Tn (normal carburizing process)

tn = carburizing time (same as above)

Tn = carburizing temperature (same as above)

It will be understood by those skilled in the art that, in order to obtain optimum results, small adjustments in Tc,s may be necessary even after using the formulas given above. Tc,s should be reduced slightly if the case depth of suspended parts is greater than the case depth of parts carburized at Tn and not suspended. Tc,s should be increased slightly if the case depth of suspended parts is less than the case depth of parts carburized at Tn and not suspended. The possible need to adjust Tc,s is a result of the large number of variables in gas carburizing and a result of inaccuracies in the measurement and control of zone temperatures and carbon potential.

Broadly speaking, Tc,s is about 10° F. to about 150° F. less than the carburizing temperature, i.e., the normal or regular carburizing temperature used by the carburizer in his day to day operations, but Tc,s, in any case, is not permitted to fall below 1400° F. or the austenitic transformation temperature of the steel, whichever is the greater of the two. It will be understood by the skilled in the art that within the range the optimum Tc,s can be arrived at by trial and error rather than by the formulae given above. The trial and error method is, of course, the least preferred route because of the great number of off specification parts which will be produced before the proper Tc,s is arrived at.

Frequently, the zones of a pusher furnace are not all at the same temperature during normal carburizing. The first zone can be considered to be a "preheat" zone and may be maintained at a different temperature than the second and further zones. The last zone can be considered to be a "diffusion" zone and may be maintained at a lower temperature than the zones preceding it. In some situations, it is undesirable to change the carburizing temperature of a particular zone. It is generally advisable, for example, to maintain the temperature of the diffusion zone at its normal temperatures so as not to change quench conditions. The equations given above are applied to each zone individually to determine the appropriate Tc,s for that zone. It should be understood, therefore, that the equivalent carburizing time (teq,susp) to be gained during shutdown can be allocated either equally or unequally among the zones. The temperature of the diffusion zone can be kept constant by allocating all of the teq,susp to the other zones. The teq,susp may even be allocated to only one zone. It is important to understand this concept when carrying out the process, i.e., that the teq,susp can be divided among one or more zones. Thus, Tc,s can be the same as the normal carburizing temperature in, e.g., the last of three zones, while the teq,susp can be divided equally among the first two zones to provide the same Tc,s in each of those zones or, if not divided equally, to provide a different Tc,s in each of the first two zones. In any case, the total teq,susp must be accounted for so that each part is exposed to sufficient Tc,s in one or more of the zones.

In actual practice, the use of Tc,s will not completely eliminate changes in case depth caused by suspended carburizing. This is because each furnace zone contains several trays of parts and takes a finite time to cool and heat. Consequently, there will be some variability in case depth between the last parts to exit the furnace before a shutdown and the first parts to exit the furnace after a shutdown, and also between the last parts to enter the furnace before the shutdown and the first parts to enter the furnace after the shutdown. The maximum difference in case depth expected at both ends is equal to the amount accumulated during the shutdown. However, the zone temperature changes can be timed such that the expected range in case depths is most appropriate for the part specifications. If the range in case depth resultant from a shutdown is greater than the specification range, the problem can be overcome by leaving a few empty trays at each end of the furnace.

Steps (b), (c), (j), and (k) are not the preferred mode in certain situations. Case depth compensation is accomplished more easily with batch furnaces by shortening the carburizing cycle. The equivalent diffusion time gained during the shutdown (teq,susp) is subtracted from the normal carburizing time (tn) to obtain the appropriate carburizing time to use for suspended parts (tc,susp), i.e., tc,susp = tn − teq,susp. Further, case depth compensation is not always needed. Parts with wide case depth specifications or furnaces with fast heating and cooling generally do not need compensation. For these situations, parts can be carburized at the normal carburizing temperatures in pusher furnaces and can be carburized for the normal time in batch furnaces.

In step (c), the parts are maintained at about the temperature determined in step (b) for the period of time which would be necessary to achieve about 1 to 99 percent carburization at the carburizing temperature set forth above, i.e., about 1500° to about 2200° F. While a part may pass through more than one zone during step (c), the period of time referred to is the total time for carrying out step (c). The total time for suspended carburizing includes one push cycle (the time it takes for a part to be pushed from furnace entrance to exit; this may entail ten to twnety pushes, for example) plus the time of shutdown of the process when no pushing occurs. The atmosphere during step (c) is the carburizing atmosphere mentioned above. This atmosphere effectively prevents decarburization and oxidation, and to accomplish this task a suitable carbon potential is needed.

Carbon potential is defined as the weight percent carbon dissolved on a steel surface in equilibrium with a furnace atmosphere. Several equilibria can be important. Equations 2 through 4 give the equilibrium reactions, while equations 5 through 7 define the carbon potentials based on these reactions:

$$CO + H_2 \overset{K_1}{\rightleftarrows} C + H_2O \quad (2)$$

$$2CO \overset{K_2}{\rightleftarrows} C + CO_2 \quad (3)$$

$$\text{Hydrocarbon} \overset{K_3}{\rightleftarrows} C + nH_2 \quad (4)$$

-continued $$C = \frac{K_1 (CO)(H_2)}{\gamma (H_2O)} \quad (5)$$

$$C = \frac{K_2 (CO)^2}{\gamma (CO_2)} \quad (6)$$

$$C = \frac{K_3 (\text{Hydrocarbon})}{\gamma (H_2)^n}$$

where:

C is the weight percent carbon dissolved in the steel $\gamma$ is the activity coefficient of carbon in steel $K_1$, $K_2$, $K_3$ are equilibrium constants.

Methane (or propane) is preferably used as an atmosphere additive to control carbon potential by reactions 8 and 9.

$$CH_4 + H_2O \rightleftharpoons CO + 3H_2 \quad (8)$$

$$CH_4 + CO_2 \rightleftharpoons 2CO + 2H_2 \quad (9)$$

The values of $K_1$, $K_2$, $K_3$ and $\gamma$ are functions of temperature. Consequently, in order to maintain a constant carbon potential during cooling or heating, the composition of the carburizing atmosphere must change. Table II gives the composition ratios based on reactions 2 and 3 of CO, $H_2$, $CO_2$ and $H_2O$ required to maintain a carbon potential of 0.8 weight percent C as temperature decreases from 1700° F. to 1400° F.

TABLE II

| Temperature °F. | $K_1$ | $K_2$ | $\gamma$ | $\frac{(CO)(H_2)}{(H_2O)}$ | $\frac{(CO)^2}{(CO_2)}$ |
|---|---|---|---|---|---|
| 1700 | .025 | .0175 | 68. | 21.8 | 31.1 |
| 1600 | .05 | .04 | 84. | 13.4 | 16.8 |
| 1500 | .10 | .10 | 105. | 8.4 | 8.4 |
| 1400 | .23 | .27 | 135. | 4.7 | 4.0 |

Adequate carbon potential is maintained during cooldown by carrying out steps (d) and (e). Step (d) may be accomplished by simply shutting off or lowering the flow of enriching gas while step (e) involves a gradual lowering of the temperature to the shutdown temperature, i.e., the temperature at which the parts will remain until start-up. The shutdown temperature can be in the range of about 100° F. to about 1400° F. and is preferably about 900° F. to about 1200° F. As mentioned above, for periods of longer than about 3 days, temperatures of less than about 600° F. are used. Step (e) is carried out by lowering the temperature controller set points and allowing the furnace to cool naturally. More rapid cooling can be achieved by flowing air through the combustion tubes, but this is generally unnecessary and may be undesirable in some furnaces. The gradual lowering of the temperature from the step (c) level to the shutdown temperature level takes about 2 to about 24 hours. As pointed out in step (f), during step (e), but before the temperature reaches about 1400° F., the carburizing atmosphere is changed to one comprising an inert atmosphere, usually an essentially nitrogen atmosphere. This is preferably accomplished before the temperature reaches about 1400° F. since some furnace safety codes require that the furnace atmosphere be nonflammable below 1400° F. because of the danger of explosion. Those carrying out subject process are cautioned to respect the explosive levels of carburizing atmospheres at temperatures below 1400° F.

The nonflammable atmosphere in steps (f), (g), and (h) is, in most cases, a nitrogen atmosphere with or without the addition of an enriching gas. Parts suspended in an essentially pure nitrogen atmosphere will develop a thin surface oxide layer because of residual water and carbon dioxide in the atmosphere. When the carburizing atmosphere is restored after the shutdown, the oxide layer will be reduced, but the original metal surface cannot be restored. Parts suspended in a pure nitrogen atmosphere may also experience surface decarburization for the same reason, i.e., residual water and carbon dioxide in the atmosphere. Oxidation can be prevented by maintaining sufficiently high $H_2/H_2O$ and $CO/CO_2$ ratios and by eliminating free oxygen from the atmosphere.

Examples of $H_2/H_2O$ and $CO/CO_2$ ratios useful in preventing oxidation at various temperatures may be found in Table III.

TABLE III

| Temperature (°F.) | $H_2/H_2O$ ratio | $CO/CO_2$ ratio |
|---|---|---|
| 600 | 40 | 1.1 |
| 800 | 11 | 1.1 |
| 1000 | 7 | .9 |
| 1200 | 4 | .9 |

Hydrogen, while capable of preventing oxidation cannot by itself prevent decarburization. Decarburization can be prevented by providing an atmosphere with very low concentrations of water, carbon dioxide, and oxygen such that the rate of decarburization is negligible.

An enriching gas can be added to the shutdown atmosphere to prevent oxidation and decarburization. The purpose of the enriching gas is to react with the carbon dioxide, water, and oxygen thereby reducing their concentrations and at the same time providing carbon monoxide and hydrogen as reaction products. As the enriching gas, unsaturated hydrocarbon such as propylene and ethylene, saturated hydrocarbon such as methane or propane, or other hydrocarbons including alcohols such as methanol or ethanol can be used. Hydrogen can also be used but it cannot reduce the water concentration and cannot prevent decarburization. The amount of enriching gas used depends on the species selected but, for safety reasons, should in no case be greater than four percent by volume of the total atmosphere. Some furnace safety codes require that the process gas used in an enclosed furnace at temperatures below 1400° F. be less than four percent total conbustibles.

A preferred way of maintaining a reducing and nondecarburizing atmosphere during cooling and shutdown, i.e., steps (e), (f), and (g), is to add propylene or ethylene to the nitrogen. The unsaturated hydrocarbon reacts with water or other oxidant resulting in a high quality atmosphere as follows:

$$C_2H_4 + 2H_2O \rightarrow 2CO + 4H_2 \quad (10)$$

$$C_3H_6 + 3H_2O \rightarrow 3CO + 6H_2 \quad (11)$$

$$C_2H_4 + 2CO_2 \rightarrow 4CO + 2H_2 \quad (12)$$

$$C_2H_4 + 1(O_2 + 4N_2) \rightarrow 2CO + 2H_2 + 4N_2 \quad (13)$$

The amount of unsaturated hydrocarbon added to the nitrogen during step (f) is about 0.1 to about 1.5 percent by volume based on the volume of the nitrogen and is preferably about 0.3 to about 0.8 percent by volume.

Preferred practice on cool down is to switch to a high flowrate of nitrogen or nitrogen plus propylene when the furnace temperature is in the range of about 1400° F. to about 1450° F. The high flowrate is continued until the furnace atmosphere is nonflammable. The flowrate is then lowered to that needed for maintenance of a high quality shutdown atmosphere. This flowrate is about 20 to about 50 percent of the high flowrate. A dew point of less than about minus 30° F. is desirable. The nitrogen plus propylene purge is continued throughout the suspend while the temperature is below about 1400° F. The high flowrate referred to here is preferably the same as the high flowrate discussed in U.S. Pat. No. 4,145,232, referred to above, for use when the furnace doors are open. It is also similar to the normally high flowrate of endo gas commonly used by industrial carburizers to insure an adequate carburizing atmosphere. In any case, specific flowrates are a function of the size of the furnace and their determination is conventional.

Step (c) is accomplished before the push cycle is stopped (in the pusher furnace). Step (d) is then carried out usually concurrently with the beginning of step (e) when the furnace temperature controllers are gradually lowered to the suspend or shutdown temperature (Ts). This cooling is usually accomplished at a rate of about 20° F. to about 150° F. per hour. Since the cooling rate is based on furnace refractory and alloy considerations, slower or faster cooling rates may occur in some furnaces. The shutdown temperature (Ts) can be in the range of about 100° F. to about 1400° F., but is preferably in the range of about 900° F. to about 1200° F. The temperature of 1000° F. is considered optimum for suspend periods of less than about 72 hours. The initial carburizing atmosphere except for the enriching gas (hydrocarbon component) is maintained until a temperature in the range of about 1200° F. to about 1700° F. is reached or, preferably, about 1400° F. to about 1500° F. As noted, some safety codes set a lower limit of 1400° F. At this temperature, the carburizing atmosphere is replaced with a non-flammable reducing atmosphere in accordance with step (f). Although any inert gas can be used, nitrogen is the gas of choice. As discussed above, a preferred atmosphere is nitrogen plus a small amount of propylene or ethylene. This may be referred to as the shutdown atmosphere. All furnace and vestibule doors remain closed throughout the period of shutdown.

In step (g), the parts are maintained in the atmosphere resulting from step (f) and at the lowest temperature achieved in step (e) for the predetermined period of time in which the carburizing process is to be shut down, which, as mentioned previously, may be overnight, or for a week-end or holiday. The preferred temperature is no lower than about 900° F. and the preferred length of time for the shutdown is no longer than about 72 hours.

After the end of the shutdown period, the furnace is heated in step (h) from the shutdown temperature to a temperature in the range of about 1200° F. to 1700° F. and preferably about 1400° F. to about 1500° F. As for the cooling in step (e), this heating is generally accomplished at a rate of about 20° F. to about 150° F. per hour. Again, as for cooling, the heating rate is based on furnace refractory and alloy considerations, and slower or faster heating rates may occur in a particular furnace.

Then, step (i) is invoked and the initial carburizing atmosphere is restored, preferably at a relatively high flowrate, again, as discussed above with reference to U.S. Pat. No. 4,145,232, until an acceptable atmosphere is achieved. At this point the flowrate is lowered to about 20 to about 40 percent of the high flowrate. This flowrate is used until the push cycle is resumed and then the flowrate is adjusted to the normal carburizing flowrate, i.e., the flowrate usually used by the carburizer in his regular carburizing operation. The hydrocarbon component is preferably introduced also at the normal rate within 20° F. to 100° F. of Tc,s, the temperature determined in step (b). The push cycle is resumed when the temperature reaches Tc,s in step (j), which is achieved in the same gradual manner as the temperature in step (h), and the original carbon potential is attained. The suspended parts then complete their cycle in step (k) which brings them to 100 percent carburization at which time they pass out of the furnace door as in step (l). The furnace temperature is raised from Tc,s to the normal carburizing temperature sequentially in the zones of the pusher furnace as the suspended parts clear each zone.

The process is essentially the same when applied to batch furnaces. The main difference is that the carbon diffusion which occurs during the shutdown can be more easily compensated for by shortening the carburizing time rather than by lowering the carburizing temperature. However, the latter technique can also be used. The suspend process is, however, preferably practiced as follows for batch furnaces:

The batch furnace is loaded at any time prior to shutdown and the length of time which accrues before the suspend is recorded. The process steps outlined above are followed except that Tc,s is equal to the normal carburizing temperature and, therefore, does not have to be calculated as per the formula. The total carburizing time at Tc,s (tc,susp) is calculated as follows:

$$t_{c,susp} = t_n \text{ minus } t_{eq,susp}$$

wherein:

$t_n$ = normal total carburizing time $t_{eq,susp}$ = equivalent carburizing time gained during the suspend calculated as above.

The invention is illustrated by the following example, which is presented in three parts. Part A gives the procedure; Part B, the calculation of Tc,s; and Part C, the results.

EXAMPLE (A) A conventional three zone, two row, gas fired commercial pusher furnace is used to carry out the process described above. The process is evaluated by comparing parts which are carburized under standard conditions to parts which are carburized under the conditions of subject process for one push cycle plus a suspend period of 48 hours. The quality control criteria used in the evaluation are case depth, hardness, surface finish, and dimensional tolerances.

The normal residence time for parts, i.e., one push cycle, in this example is 6.0 hours. The normal carburizing temperatures are 1700° F. in zones 1 and 2 and 1560° F. in zone 3. Parts are oil quenched and then tempered at 350° F. for 40 minutes at temperature. The parts are made from several alloys including SAE 1117, 1118, 1524, 8617, and 8620. Standard parts are carburized under normal conditions either several hours before or after the shutdown. Suspended parts are carburized as per subject process but are held in the furnace during a 48 hour shutdown. Both standard and suspended parts are carburized in 24×24 inch trays with loads varying from 70 to 250 pounds depending on the part.

The normal carburizing atmosphere is as follows:

| component of atmosphere | percent by volume |
|---|---|
| carbon monoxide | 16 to 20 |
| hydrogen | 39 to 46 |
| nitrogen | 29 to 43 |
| carbon dioxide | 0.05 to 0.3 |
| water vapor | 0.15 to 0.5 |
| methane | 2 to 4 |

The term "normal" designates the parameters used when the regular carburizing process is being carried out. The source of the atmosphere is a mixture of 40 percent by volume nitrogen and 60 percent by volume dissociated methanol based on the total volume of the mixture. The high flowrate of nitrogen plus dissociated methanol under normal carburizing conditions is 800 scfh, while the low flowrate is 260 scfh.

It is desired in 6 hours to suspend carburizing for 48 hours and to maintain the furnace during this period with a full load of parts. It is known that the parts entering Zone 1 with not complete the full cycle prior to shutdown. Tc,s is determined according to the formula as in Part B to be 1640° F. for zones 1 and 2 and 1560° F. for zone 3. The temperature setpoints for zones 1 and 2 are reduced to Tc,s approximately 5 and 3 hours, respectively, before shutdown. Zone 3 is maintained at 1560° F. The push cycle is continued until all of the parts in the furnace are to undergo the shutdown.

The methane is turned off and the temperature is lowered at a rate of about 100° F. per hour until the temperature is about 1400° F. at which time the atmosphere is purged with premixed nitrogen and 0.5 percent by volume of propylene (based on the volume of nitrogen) at 800 scfh, which, again, is about equal to the normal high carburizing flowrate. When the atmosphere is non-flammable, after about 3 to 5 volume changes, the flowrate of nitrogen and 0.5 percent propylene is reduced to about 30 to 40 percent of the normal high carburizing flowrate. Once the temperature reaches 1000° F., it is held at that temperature and the purge, which provides a reducing atmosphere, is maintained. At the end of the shutdown, the temperatures in zones 1,2, and 3 are raised, respectively, to Tc,s, i.e., 1640° F., 1640° F., and 1560° F. Heating proceeds to these temperatures at a rate of 100° F. per hour. When 1400° F. is reached, the initial carburizing atmosphere is reestablished at 800 scfh which, again, is about equal to the normal high flowrate. Once the carburizing atmosphere has been established, after about 3 to 5 volume charges, the flowrate is reduced to about 260 scfh, which is about equal to the normal low flowrate. Methane is added at its normal flowrate of about 50 scfh when the furnace temperature reaches about 50° F. less than Tc,s. Pushing begins when Tc,s is reached and the suspended parts complete the cycle at Tc,s and are pushed out of the furnace. As the parts leave each zone, the carburizing temperature of 1700° F. is restored to the zones 1 and 2 and new parts are introduced into the normal carburizing cycle. This restoration of the 1700° F. temperature in zones 1 and 2 takes place about 1 and 3 hours, respectively, after the push cycle is resumed.

(b) The temperature Tc,s at about which the parts introduced in step (a) are to be maintained in step (c) is determined by employing the following formula:

$$Tc,s = \left[ -\frac{R}{Q} \ln\left( \frac{tn - teq,susp}{tn} \right) + \frac{1}{Tn} \right]^{-1}$$

wherein:

R=gas constant=1.987 BTU/mole ° R.

Q=activation energy for carbon diffusion in austenite=61900 BTU/mole

It is desired to maintain the temperature of zone 3, which is the diffusion zone, at its normal carburizing temperature of 1560° F. Therefore, all case depth compensation will be accomplished in zones 1 and 2, i.e., teq,susp will be allocated equally between zones 1 and 2 and none of teq,susp will be allocated to zone 3. Since teq,susp is allocated to zones 1 and 2, tn=4 hours (2 hours in zone 1+2 hours in zone 2), and Tn=2160° R. (1700° F.), which is the normal carburizing temperature of zones 1 and 2. The expression, teq,susp is calculated using the summation formula. The calculation of teq,susp is illustrated in Table IV and is based on actual carburizing furnace temperatures during the cooling and heating periods of the suspend process.

TABLE IV

Calculation of teq,susp

Cooling Period

| j | Δ tj (hour) | Tj (°R.) | $\exp\left[-\frac{Q}{R}\left(\frac{1}{Tj}-\frac{1}{Tn}\right)\right]$ Δ tj |
|---|---|---|---|
| 1 | 0.5 | 2030 | 0.200 |
| 2 | 0.5 | 1950 | 0.106 |
| 3 | 0.5 | 1925 | 0.086 |
| 4 | 0.5 | 1895 | 0.066 |
| 5 | 0.5 | 1870 | 0.053 |
| 6 | 0.5 | 1850 | 0.044 |
| 7 | 0.5 | 1830 | 0.034 |

$$\sum_{j=1}^{nc=7} \exp\left[-\frac{Q}{R}\left(\frac{1}{Tj}-\frac{1}{Tn}\right)\right] \Delta tj = 0.592$$

Heating Period

| j | Δ tj (hour) | Tj (°R.) | $\exp\left[-\frac{Q}{R}\left(\frac{1}{Tj}-\frac{1}{Tn}\right)\right]$ Δ tj |
|---|---|---|---|
| 1 | 0.5 | 1810 | 0.031 |
| 2 | 0.5 | 1860 | 0.049 |
| 3 | 0.5 | 1940 | 0.095 |
| 4 | 0.5 | 1960 | 0.097 |
| 5 | 0.5 | 2040 | 0.214 |
| 6 | 0.5 | 2060 | 0.248 |

$$\sum_{j=1}^{nh=6} \exp\left[-\frac{Q}{R}\left(\frac{1}{Tj}-\frac{1}{Tn}\right)\right] \Delta tj = 0.734$$

teq,susp = 0.592 + 0.734 = 1.33

Knowing that teq,susp is 1.33 hours, Tc,s can now be calculated using the formula given in step (b):

$$Tc,s = \left[ -\frac{R}{Q} \ln\left( \frac{tn - teq,susp}{tn} \right) + \frac{1}{Tn} \right]^{-1}$$

-continued $$T_{c,s} = \left[ -\frac{1.987}{61900} \ln\left(\frac{4 - 1.33}{4}\right) + \frac{1}{2160} \right]^{-1}$$

$$T_{c,s} = 2100° \text{ R.} = 1640° \text{ F.}$$

Therefore, Tc,s for zones 1, 2 and 3 will be 1640° F., 1640° F., and 1560° F., respectively.

(C) Case Depth—Case depth is measured by gradient bar and microhardness profile. The gradient bars are analyzed by machining the samples in stages and measuring the percent carbon content of the turnings. The case depth results discussed below are obtained by plotting percent carbon verses depth, and determining the depth at 0.4 percent carbon for effective case and at 0.25 percent carbon for total case depth.

A comparison of gradient bar case depth results for suspended and not suspended parts is given in Table V. The furnace location of each suspended sample during the 48 hour shutdown is shown. Parts suspended in zone 3 are almost fully carburized at the beginning of the suspend. The first suspended sample listed in Table V is in the first tray of parts to be pushed out of the furnace after the shutdown. The sample accumulates 5.25 hours of carburizing time prior to the suspend, only 0.25 hour less than a full cycle. Parts suspended in zone 1 are in the furnace for only a short time prior to the suspend. The last suspended sample listed in Table V is in the last tray of parts to be pushed into the furnace before the shutdown.

TABLE V

| Case Depth Results for Suspended Parts and Normal Production | | |
|---|---|---|
| Processing | Effective Case Depth at 0.4 Weight percent C (inches) | Total Case Depth at 0.25 Weight percent C (inches) |
| Not Suspended[1] | .035 | .049 |
| Not Suspended | .037 | .050 |
| Not Suspended | .033 | .046 |
| Not Suspended | .032 | .045 |
| Not Suspended | .032 | .046 |
| Not Suspended-Mean | .034 | .047 |
| Not Suspended-Range | .032–.037 | .045–.050 |
| Suspended-Zone 3[2] | .034 | .051 |
| Suspended-Zone 3 | .034 | .051 |
| Suspended-Zone 3 | .035 | .052 |
| Suspended-Zone 2 | .031 | .047 |
| Suspended-Zone 1 | .031 | .046 |
| Suspended-Zone 1 | .031 | .046 |
| Suspended-Zone 1 | .032 | .047 |
| Suspended-Mean | .033 | .048 |
| Suspended-Range | .031–.035 | .046–.052 |

[1]Carburized for 5.5 hours, not suspended
[2]Carburized for 5.5 hours, suspendeed for 48 hours in zone indicated There is no significant difference between the case depths of suspended and not suspended samples. The suspended samples have a mean effective case depth of 0.033 inch as compared to 0.034 inch for the not suspended samples. The mean total case depth of suspended samples is 0.048 inch as compared with 0.047 inch for the not suspended samples. The observed range in case depths is also within normal variations. Despite 48 hours additional residence time in the furnace, none of the suspended parts has excessive case depth.

Microhardness profiles are used to check the gradient bar results. The range in effective case depths at Rc50 for the suspended samples listed in Table V is 0.032 to 0.038 inch. One not suspended sample is checked and found to have an effective case depth at Rc50 of 0.036 inch, which is typical of normal production. The microhardness profile results confirm that the case depth of suspended samples is both acceptable and not significantly different from the case depth of not suspended samples.

Surface and Core Hardness—The Rockwell C surface hardness of parts suspended is measured both before and after tempering. The results are presented in Table VI. About 5 parts are checked from each tray indicated. Tray 1 is the first tray pushed out of the furnace after the shutdown. The surface hardness of all parts is within normal variation.

TABLE VI

| Surface Hardness of Suspended Parts | | |
|---|---|---|
| | Surface Hardness | |
| Tray Number | As Quenched (Rockwell C) | As Tempered[1] (Rockwell C) |
| 1 | 61–64 | 59–60 |
| 3 | 63–65 | 57–59 |
| 5 | 62–64 | 58–59 |
| 6 | 63–64 | 57–60 |
| 7 | 62–63 | 58–60 |
| 8 | 63–64 | 57–59 |
| 9 | 63–64 | 59–61 |
| 10 | 62–64 | 60–60 |
| 11 | 64–64 | 60–61 |
| 12 | 63–64 | 58–60 |
| 13 | 62–63 | 58–60 |
| 14 | 63–64 | 59–60 |
| 15 | 61–63 | 59–60 |
| 16 | 62–64 | 58–60 |
| 17 | 62–63 | 59–60 |
| 18 | 63–64 | 60–60 |
| 19 | 62–63 | 57–59 |

[1]Normal as tempered hardness is 57–61.

In Table VII, the surface hardness results are summarized, and hardness measurements taken at the half radius and core of three suspended parts are given. The data show that the surface hardness of suspended parts is no different from that of normal production. The half radius and core hardness are also completely acceptable and no different from normal production.

TABLE VII

| Hardness of Suspended Parts and Normal Production | | | | | | |
|---|---|---|---|---|---|---|
| | Rockwell C Hardness[1] | | | | | |
| | Surface | | Half Radius | | Core | |
| Processing | Mean | Range | Mean | Range | Mean | Range |
| Not Suspended | 60 | 57–61 | 34 | 28–39 | 25 | 10–34 |
| Suspended Zone 3 | 59 | 57–60 | 34 | 30–38 | 21 | 16–29 |
| Suspended Zone 2 | 59 | 57–61 | 30 | | 16 | |
| Suspended Zone 1 | 59 | 57–60 | 38 | | 29 | |

[1]All results are after tempering.

Dimensional Tolerances—Several types of shafts are carburized which must meet straightness specifications. Table VIII gives the results of quality control straightness tests in which suspended parts are compared with normal production. About 60 suspended crankshafts (SAE 1118) are checked per zone. The results show that straightness is not affected by the 48 hour suspend. The shafts are within specification and are no different from normal production.

TABLE VIII

Shaft Straightness of Suspended and Normal Production Parts

| Processing | Total Indicator Runout Mean (inches) | Total Indicator Runout Range (inches) |
|---|---|---|
| Not Suspended | .005 | .001–.013 |
| Suspended - Zone 3 | .004 | .001–.008 |
| Suspended - Zone 2 | .004 | .001–.009 |
| Suspended - Zone 1 | .006 | .002–.014 |

Notes:
1. Crankshafts, SAE 1118.
2. Not suspended parts carburized for 5.5 hours.
3. Suspended parts carburized for 5.5 hours and suspended for 48 hours as per subject process.

Several types of gears are also carburized which must meet bore diameter specifications. Table IX compares the change in bore diameter for three different types of gears processed either with or without a 48 hour shutdown. Each mean and range result is obtained by measuring the bore diameter of five gears before and after processing. The suspend samples are in trays positioned throughout the furnace during the shutdown. Bore diameter is not affected by the shutdown. All gears are within specification and are no different from normal production.

TABLE IX

Change in Bore Diameter of Suspended and Normal Production Parts

| Processing | Part[1] | Change in Bore Diameter[2] Mean (inches) | Change in Bore Diameter[2] Range (inches) |
|---|---|---|---|
| Not Suspended | A | .0012 | .0006–.0015 |
| Suspended | A | .0013 | .0004–.0021 |
| Not Suspended | B | .0015 | .0005–.002 |
| Suspended | B | .0013 | .0008–.0019 |
| Not Suspended | C | .0008 | .0005–.001 |
| Suspended | C | .0003 | .0001–.0005 |

[1]All are SAE 1117.
[2]Bore diameter after heat treatment - Bore diameter before heat treatment
Bore diameter of all parts = 1.0 ± 0.1 inch.

None of the parts suspended are press quenched after carburizing. However, results are obtained on ~12 inch diameter gears which are press quenched after being suspended in a three-row, five-zone, industrial pusher furnace. A comparison of the dimensional quality control results is given in Table X. The suspend results are a mean of measurements taken on five samples, one of which is located in each zone during the 48 hour shutdown. The not suspended sample results are a mean of measurements taken on two samples which are carburized a few hours after the shutdown. The results given in Table X show that the suspend process does not affect dimensional tolerances of press quenched parts. The dimensions of all suspended gears are acceptable and not significantly different from the dimensions of normal production.

TABLE X

Dimensional Tolerances of Press Quenched Gears

| Measurement | Suspended[1] (inches) | Not Suspended[2] (inches) |
|---|---|---|
| Tenon Diameter | +.0088 | +.0085 |
| Tenon out of Round | .0032 | .0035 |
| Internal Bore | +.0041 | +.0053 |
| Internal Bore O.R. | .0022 | .0040 |
| Quench Face Flatness | .0034 | .0025 |
| Quench Face Taper | +.0042 | +.0033 |

[1]Mean of 5 samples, one per zone.
[2]Mean of 2 samples.

We claim:

1. In a process for carburizing steel parts in a furnace having one or more temperature zones at a carburizing temperature in the range of about 1500° F. to about 2200° F. in a carburizing atmosphere comprising

| component of atmosphere | percent by volume |
|---|---|
| carbon monoxide | about 4 to about 30 |
| hydrogen | about 10 to about 60 |
| nitrogen | about 10 to about 85 |
| carbon dioxide | 0 to about 4 |
| water vapor | 0 to about 5 |
| hydrocarbon | about 1 to about 10, |

said percent by volume being based on the total volume of the atmosphere, wherein it is desired to shut down the carburizing process for a predetermined period of time without removing the parts, which have not achieved 100 percent carburization, from the furnace, the improvement comprising the following steps:

(a) introducing parts, which would not achieve 100 percent carburization prior to the shutdown of the carburizing process, into the furnace;

(b) determining the temperature (Tc,s) for each temperature zone at about which the parts introduced in step (a) are to be maintained in step (c) according to the following formula:

$$Tc,s = \left[ -\frac{R}{Q} \ln\left( \frac{tn - teq,susp}{tn} \right) + \frac{1}{Tn} \right]^{-1}$$

wherein:

$$teq,susp = \int_{ti}^{ta,c} \exp\left[ -\frac{Q}{R}\left( \frac{1}{T} - \frac{1}{Tn} \right) \right] dt + \int_{ta,h}^{tf} \exp\left[ -\frac{Q}{R}\left( \frac{1}{T} - \frac{1}{Tn} \right) \right] dt,$$

teq,susp being allocated to at least one temperature zone

R = gas constant

Q = activation energy for carbon diffusion in austenite ln = natural log tn = carburizing time ti = time at beginning of shutdown ta,c = time during cooling at which T = Ta ta,h = time during heating at which T = Ta tf = time at end of shutdown at which T = Tc,s Tn = carburizing temperature T = temperature during cooling and heating, a function of time, t Ta=austenitic transformation temperature, provided that Tc,s is no less than about 1400° F. or the austenitic transformation temperature of the steel, whichever is the greater;

(c) maintaining the parts in the carburizing atmosphere in at least one of the temperature zones for the period of time, which would be necessary to achieve about 1 to about 99 percent carburization at the carburizing temperature, each of said temperature zones being at the temperature determined in step (b) for the temperature zone;

(d) reducing the amount of the hydrocarbon component of the atmosphere;

(e) gradually lowering the temperature from the level of step (c) to a predetermined level, less than about 1400° F.;

(f) during step (e), but before the temperature reaches about 1400° F., changing the atmosphere to one comprising an inert atmosphere;

(g) maintaining the parts in the atmosphere, which is the result of step (f), for the predetermined period of time;

(h) after the predetermined period of time expires, heating the furnace to a temperature in the range of about 1400° F. to about 1500° F.;

(i) changing the atmosphere to the carburizing atmosphere;

(j) raising the temperature in each zone to about the temperature determined in step (b);

(k) maintaining the parts at the temperature of step (j) for the period of time necessary to bring the carburization initiated in step (c) to about 100 percent carburization; and (l) removing the parts from the furnace.

2. The process defined in claim 1 wherein, in step (f), the atmosphere is changed to an atmosphere consisting essentially of nitrogen plus about 0.1 to about 1.5 percent by volume of ethylene or propylene based on the volume of nitrogen.

3. The process defined in claim 2 wherein the temperature in step (e) is in the range of about 900° F. to about 1100° F.

4. The process defined in claim 2 wherein the temperature in step (f) is in the range of about 1200° F. to about 1700° F.

5. The process defined in claim 3 wherein the temperature in step (f) is in the range of about 1400° F. to about 1500° F.

6. In a process for carburizing steel parts in a furnace having one or more temperature zones at a carburizing temperature in the range of about 1500° F. to about 2200° F. in a carburizing atmosphere comprising

| component of atmosphere | percent by volume |
|---|---|
| carbon monoxide | about 4 to about 30 |
| hydrogen | about 10 to about 60 |
| nitrogen | about 10 to about 85 |
| carbon dioxide | 0 to about 4 |
| water vapor | 0 to about 5 |
| hydrocarbon | about 1 to about 10, |

said percent by volume being based on the total volume of the atmosphere, wherein it is desired to shut down the carburizing process for a predetermined period of time without removing the parts, which have not achieved 100 percent carburization, from the furnace, the improvement comprising the following steps:

(a) introducing parts, which would not achieve 100 percent carburization prior to the shutdown of the carburizing process, into the furnace;

(b) determining the temperature (Tc,s) for each temperature zone at about which the parts introduced in step (a) are to be maintained in step (c) according to the following formula:

$$Tc,s = \left[ -\frac{R}{Q} \ln\left( \frac{tn - teq,susp}{tn} \right) + \frac{1}{Tn} \right]^{-1}$$

wherein:

$$teq,susp = \sum_{j=1}^{nc} \exp\left[ -\frac{Q}{R}\left( \frac{1}{Tj} - \frac{1}{Tn} \right) \right] \Delta tj$$

$$\sum_{j=1}^{nh} \exp\left[ -\frac{Q}{R}\left( \frac{1}{Tj} - \frac{1}{Tn} \right) \right] \Delta tj$$

wherein the first summation applies to the cooling steps of the process and the second summation applies to the heating steps of the process and nc=number of time increments during cooling from Tc,s to Ta nh=number of time increments during heating from Ta to Tc,s Tj=average temperature during time increment j Δtj=length of time increment j R=gas constant Q=activation energy for carbon diffusion in austenite ln=natural log tn=carburizing time Tn=carburizing temperature Ta=austenitic transformation temperature, provided that Tc,s is no less than about 1400° F. or the austenitic transformation temperature of the steel, whichever is the greater;

(c) maintaining the parts in the carburizing atmosphere in at least one of the temperature zones for the period of time, which would be necessary to achieve about 1 to about 99 percent carburization at the carburizing temperature, each of said temperature zones being at the temperature determined in step (b) for that temperature zone;

(d) reducing the amount of the hydrocarbon component of the atmosphere;

(e) gradually lowering the temperature from the level of step (c) to a predetermined level, less than about 1400° F.;

(f) during step (e), but before the temperature reaches about 1400° C., changing the temperature to one comprising an inert atmosphere;

(g) maintaining the parts in the atmosphere, which is the result of step (f), for the predetermined period of time;

(h) after the predetermined period of time expires, heating the furnace to a temperature in the range of about 1400° F. to about 1500° F.;

(i) changing the atmosphere to the carburizing atmosphere;

(j) raising the temperature in each zone to about the temperature determined in step (b);

(k) maintaining the parts at the temperature of step (j) for the period of time necessary to bring the carburization initiated in step (c) to about 100 percent carburization; and (l) removing the parts from the furnace.

7. The process defined in claim 6 wherein, in step (f), the atmosphere is changed to an atmosphere consisting essentially of nitrogen plus about 0.1 to about 1.5 percent by volume of ethylene or propylene based on the volume of nitrogen.

8. The process defined in claim 7 wherein the temperature in step (e) is in the range of about 900° F. to about 1100° F.

9. The process defined in claim 7 wherein the temperature in step (f) is in the range of about 1200° F. to about 1700° F.

10. The process defined in claim 8 wherein the temperature in step (f) is in the range of about 1400° F. to about 1500° F.

11. In a process for carburizing steel parts in a furnace having one or more temperature zones at a carburizing temperature in the range of about 1500° F. to about 2200° F. in a carburizing atmosphere comprising

| component of atmosphere | percent by volume |
|---|---|
| carbon monoxide | about 4 to about 30 |
| hydrogen | about 10 to about 60 |
| nitrogen | about 10 to about 85 |
| carbon dioxide | 0 to about 4 |
| water vapor | 0 to about 5 |
| hydrocarbon | about 1 to about 10, |

said percent by volume being based on the total volume of the atmosphere, wherein it is desired to shut down the carburizing process for a predetermined period of time without removing the parts, which have not achieved 100 percent carburization, from the furnace, the improvement comprising the following steps:

(a) introducing parts, which would not achieve 100 percent carburization prior to the shutdown of the carburizing process, into the furnace;

(b) determining the temperature (Tc,s) for at least one temperature zone at about which the parts introduced in step (a) are to be maintained by selecting a temperature in the range of about 20° F. to about 150° F. below the carburizing temperature, provided that Tc,s is no less than about 1400° F. or the austenitic transformation temperature of the steel, whichever is the greater;

(c) maintaining the parts in the carburizing atmosphere in at least one of the temperature zones for the period of time, which would be necessary to achieve about 1 to about 99 percent carburization at the carburizing temperature, each of said temperature zones being at the temperature determined in step (b) for the temperature zone;

(d) reducing the amount of the hydrocarbon component of the atmosphere;

(e) gradually lowering the temperature from the level of step (c) to a predetermined level, less than about 1400° F.;

(f) during step (e), but before the temperature reaches about 1400° F., changing the atmosphere to one comprising an inert atmosphere;

(g) maintaining the parts in the atmosphere, which is the result of step (f), for the predetermined period of time;

(h) after the predetermined period of time expires, heating the furnace to a temperature in the range of about 1400° F. to about 1500° F.;

(i) changing the atmosphere to the carburizing atmosphere;

(j) raising the temperature in each zone to about the temperature determined in step (b);

(k) maintaining the parts at the temperature of step (j) for the period of time necessary to bring the carburization initiated in step (c) to about 100 percent carburization; and (l) removing the parts from the furnace.

12. The process defined in claim 11 wherein, in step (f), the atmosphere is changed to an atmosphere consisting essentially of nitrogen plus about 0.1 to about 1.5 percent by volume of ethylene or propylene based on the volume of nitrogen.

13. The process defined in claim 12 wherein the temperature in step (e) is in the range of about 900° F. to about 1100° F.

14. The process defined in claim 12 wherein the temperature in step (f) is in the range of about 1200° F. to about 1700° F.

15. The process defined in claim 13 wherein the temperature in step (f) is in the range of about 1400° F. to about 1500° F.

16. In a process for carburizing steel parts in a furnace having one or more temperature zones at a carburizing temperature in the range of about 1500° F. to about 2200° F. in a carburizing atmosphere comprising

| component of atmosphere | percent by volume |
|---|---|
| carbon monoxide | about 4 to about 30 |
| hydrogen | about 10 to about 60 |
| nitrogen | about 10 to about 85 |
| carbon dioxide | 0 to about 4 |
| water vapor | 0 to about 5 |
| hydrocarbon | about 1 to about 10, |

said percent by volume being based on the total volume of the atmosphere, wherein it is desired to shut down the carburizing process for a predetermined period of time without removing the parts, which have not achieved 100 percent carburization, from the furnace, the improvement comprising the following steps:

(a) introducing parts, which would not achieve 100 percent carburization prior to the shutdown of the carburizing process, into the furnace;

(b) determining the temperature (Tc,s) for each temperature zone at about which the parts introduced in step (a) are to be maintained in step (c) according to the following formula:

$$Tc,s = \left[ -\frac{R}{Q} \ln\left( \frac{tn - teq,susp}{tn} \right) + \frac{1}{Tn} \right]^{-1}$$

wherein:

$$teq,susp = \left[ \left( \frac{Xs}{Xn} \right)^2 - 1 \right] tn,$$

teq,susp being allocated to at least one temperature zone

R = gas constant

Q=activation energy for carbon diffusion in austenite ln=natural log tn=carburizing time Tn=carburizing temperature Xs=case depth of parts subjected to carburizing in a test load where Tc,s=Tn Xn=case depth of parts carburized at Tn, provided that Tc,s is no less than about 1400° F. for the austenitic transformation temperature of the steel, whichever is the greater;

(c) maintaining the parts in the carburizing atmosphere in at least one of the temperature zones for the period of time, which would be necessary to achieve about 1 to about 99 percent carburization at the carburizing temperature, each of said temperature zones being at the temperature determined in step (b) for that temperature zone;

(d) reducing the amount of the hydrocarbon component of the atmosphere;

(e) gradually lowering the temperature from the level of step (c) to a predetermined level, less than about 1400° F.;

(f) during step (e), but before the temperature reaches about 1400° F., changing the atmosphere to one comprising an inert atmosphere;

(g) maintaining the parts in the atmosphere, which is the result of step (f), for the predetermined period of time;

(h) after the predetermined period of time expires, heating the furnace to a temperature in the range of about 1400° F. to about 1500° F.;

(i) changing the atmosphere to the carburizing atmosphere;

(j) raising the temperature in each zone to about the temperature determined in step (b);

(k) maintaining the parts at the temperature of step (j) for the period of time necessary to bring the carburization initiated in step (c) to about 100 percent carburization; and (l) removing the parts from the furnace.

17. The process defined in claim 16 wherein, in step (f), the atmosphere is changed to an atmosphere consisting essentially of nitrogen plus about 0.1 to about 1.5 percent by volume of ethylene or propylene based on the volume of nitrogen.

18. The process defined in claim 17 wherein the temperature in step (e) is in the range of about 900° F. to about 1100° F.

19. The process defined in claim 17 wherein the temperature in step (f) is in the range of about 1200° F. to about 1700° F.

20. The process defined in claim 18 wherein the temperature in step (f) is in the range of about 1400° F. to about 1500° F.

* * * * *

UNITED STATES PATENT AND TRADEMARK OFFICE

CERTIFICATE OF CORRECTION

PATENT NO. : 4306919

DATED : December 22, 1981

INVENTOR(S) : Roberge, R. P. and Solomon, J.

It is certified that error appears in the above—identified patent and that said Letters Patent is hereby corrected as shown below:

At column 20, after equation at lines 16, 17 and 18, insert a plus sign or the word --plus--.

At column 23, line 10, change "for" to --or--.

Signed and Sealed this

Sixth Day of April 1982

[SEAL]

*Attest:*

GERALD J. MOSSINGHOFF

*Attesting Officer*

*Commissioner of Patents and Trademarks*